US005749799A

United States Patent [19]

Jasperson

[11] Patent Number: 5,749,799

[45] Date of Patent: May 12, 1998

[54] LAVA-PRODUCING PLAYBALL

[76] Inventor: Ann Jasperson, 349 Havirland Rd., Stamford, Conn. 06903

[21] Appl. No.: 872,000

[22] Filed: Jun. 18, 1997

[51] Int. Cl.[6] ..... A63B 41/00

[52] U.S. Cl. ..... 473/594; 40/406

[58] Field of Search ..... 473/569, 571, 473/577, 594, 595, 610; 446/166, 267; 40/406, 407

[56] References Cited

U.S. PATENT DOCUMENTS

| | | | |
|---|---|---|---|
| 1,800,811 | 4/1931 | Wolfe | 473/594 |
| 2,515,171 | 7/1950 | Abel | 446/166 |
| 3,101,564 | 8/1963 | Stoessel | 40/407 |
| 3,387,396 | 6/1968 | Smith | 40/406 |
| 4,057,921 | 11/1977 | Ball | 40/406 |
| 4,208,848 | 6/1980 | Kohl | 40/406 |
| 4,582,498 | 4/1986 | Tamada | 446/267 |
| 4,952,190 | 8/1990 | Tarnoff et al. | 446/267 |

*Primary Examiner*—Steven B. Wong

[57] ABSTRACT

A playball which when manipulated by a player produces a display simulating the flow of lava whereby the player, in effect, has lava on his hands. The playball is formed of a transparent plastic sphere divided at its equator into two half-sections by a partition having several shaped openings dispersed therein. The sphere is filled with a clear oil in which is deposited a charge of water-based syrup having a distinctive color. The syrup which is immiscible with the oil normally forms a pool on the bottom of the lower section of the sphere. When a player turns the ball upside down so that the lower section containing the pool is then the upper section of the sphere, the syrup then impinges on the partition to flow through the openings therein into the section below. In doing so, the flowing syrup simulates rivulets of lava which collect at the bottom of the lower section to reform the pool.

9 Claims, 1 Drawing Sheet

LAVA-PRODUCING PLAYBALL

BACKGROUND OF INVENTION

1. Field of Invention

This invention relates generally to transparent plastic balls which when manipulated by a player produce a decorative display, and more particularly to a ball of this type in which the decorative display simulates flowing rivulets of volcanic lava.

2. Status of Prior Art

The invention resides in a transparent plastic playball which when manipulated by a player produces a decorative display simulating flowing rivulets of lava, so that the player, in effect, has lava on his hands.

The reason many children have a strong interest in lava is that they have seen TV and motion picture presentations of volcanic activity. These show molten rock that flows through vents and fissures to create multiple lava streams or rivulets. The most dramatic aspect of this activity is when the lava rivulets flow down the sides of a mountain to wash over trees, houses and other objects in their paths.

Also many children are fascinated by accounts of the ancient city of Pompeii at the foot of Mount Vesuvius which was buried in lava when Mount Vesuvius erupted. This happened so quickly that the residents of this town appear to have been frozen in the positions they occupied at the time of the eruption.

Yet prior to the present invention no existing toy was capable of simulating the flow of lava, thereby making it possible for a child to appreciate the nature of this activity.

But the prior art does disclose transparent balls which, when manipulated, produce various types of decorative effects.

Thus the Abel U.S. Pat. No. 2,515,171 shows a transparent ball divided by a partition having openings therein into two hemispheres, each containing floatable objects. Water contained in the upper compartment in which the objects float, trickles through the openings in the partition into the lower compartment to float the objects therein. However, no lava-like effects are produced by this ball.

The Tarnoff U.S. Pat. No. 4,952,190 shows a deformable ball formed of a flexible plastic sphere filled with mineral oil. Intermingled with this oil are reddish-brown microspheres. No lava effects are produced.

The Tamada U.S. Pat. No. 4,582,498 shows a toy in which a transparent bottle is filled with two liquids having different specific gravities which do not mix with each other. Normally, one liquid forms an upper layer in the bottle and the other, a lower layer. But when the bottle is shaken, one liquid flows into the other. Lava-like effects are not produced in this patent.

U.S. Pat. No. 4,057,921 to Ball discloses a device having chambers which contain two oils of different color and different specific gravities. When the device is inverted, the oil of one color flows into the oil of the other color. But this device is not a ball, and it does not produce lava-like effects.

SUMMARY OF INVENTION

In view of the foregoing, the main object of this invention is to provide a playball which when manipulated by a player, then produces a display simulating the flow of lava.

A significant feature of this playball is that the display takes place in the hands of the player grasping the playball, so that in effect the player has lava on his hands.

More particularly, an object of this invention is to provide a playball of the above type in which a transparent plastic sphere is filled with a clear oil, such as mineral oil having deposited therein a water-based syrup that is immiscible in the oil. When the charge of syrup which has a distinctive color is cause to flow in different paths through the colorless oil medium, it then simulates the flow of lava.

Still another object of the invention is to provide a ball of the above type which is inexpensive to manufacture and safe to use in the hands of children.

Briefly stated, these objects are attained by a playball which when manipulated by a player produces a display simulating the flow of lava whereby the player in effect, has lava in his hands. The playball is formed of a transparent plastic sphere divided at its equator into two half-sections by a partition having several shaped openings dispersed therein.

The sphere is filled with a clear oil in which is deposited a charge of water-based syrup having a distinctive color. The syrup which is immiscible with the oil normally forms a pool on the bottom of the lower section of this sphere. When a player turns the ball upside down so that the lower section containing the pool is then the upper section of the sphere, the syrup then impinges on the partition to through the openings therein into the section below. In doing so the flowing syrup simulates rivulets of lava which collect at the bottom of the lower section to reform the pool.

BRIEF DESCRIPTION OF DRAWING

For a better understanding of the invention, as well as further features thereof, reference is made to the detailed description thereof to be read in connection with the annexed drawings wherein.

DESCRIPTION OF INVENTION

Figure 1:
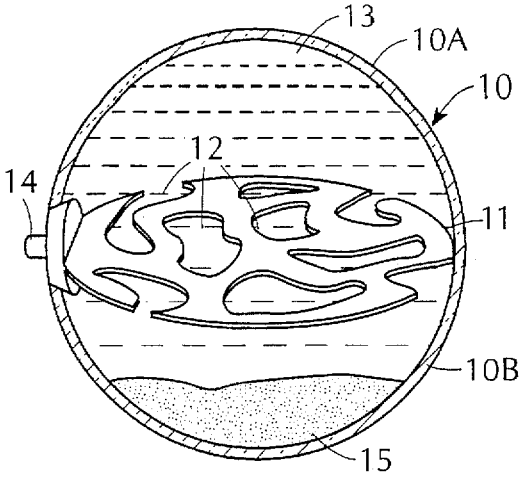
FIG. 1 is a perspective view of a playball in accordance with the invention.

Referring now to FIG. 1 shown therein is a playball in accordance with the invention that includes a transparent sphere 10 formed of synthetic plastic material of high clarity, such as PVC, polyethylene or an acrylic resin. The diameter of the sphere may range from 2½ inches to much larger ball sizes. Sphere 10 is composed of a pair of half-sections 10A and 10B which are sealed together at equator 11 so that the sphere is leak proof.

Figure 4:
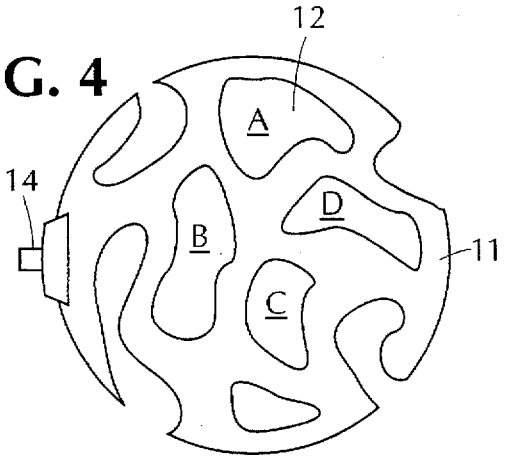
FIG. 4 is a plan view of the partition included in the ball.

Mounted within sphere 10 in line with its equator is a partition as best seen in FIG. 4 formed by a plate 12 of clear synthetic plastic material having several irregularly-shaped openings A, B, C, D, etc., dispersed over the surface of the plate. Each opening provides a passage between the two half-sections of the sphere.

Figure 2:
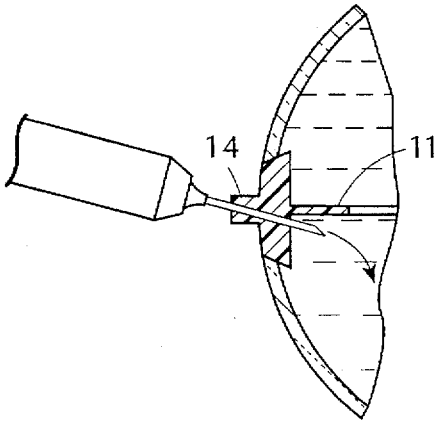
FIG. 2 illustrates how the ball has liquid injected therein.

Aligned with partition 12 is an inlet valve 14 in the form of a cylindrical plug of soft plastic material through which liquid, as shown in FIG. 2, may be injected into the sphere by means of a hypodermic needle. When the needle is withdrawn from the plug, the plug then seals itself to prevent the liquid injected in the sphere from leaking out.

Sphere 10 is filled with a clear oil, such as a light mineral oil 13 of edible quality, such as is used as a cooking oil. The reason this oil is preferably of acceptable food quality is that should the oil leak out of the sphere and be consumed by a child, it will in no way be injurious to the child.

Deposited in mineral oil 13 is a charge of a water-based syrup 15 having a distinct color, such as dark green, so that the syrup stands out against the clear mineral oil. A syrup is a sweet viscous liquid consisting of a sugar base and water. A preferred syrup for the ball is corn syrup in which the sugar base is corn starch. The syrup which is of food grade quality includes an FDA approved dye or coloring agent to impart the distinctive color thereto.

Because water-based syrup 15 is immiscible in oil 13, when as shown in FIG. 1, the playball is placed so that half-section 10B is then the lower section of the sphere, the charge of syrup 15 will then collect as a pool at the bottom of half-section 10B, with the oil floating above this pool.

Figure 3:
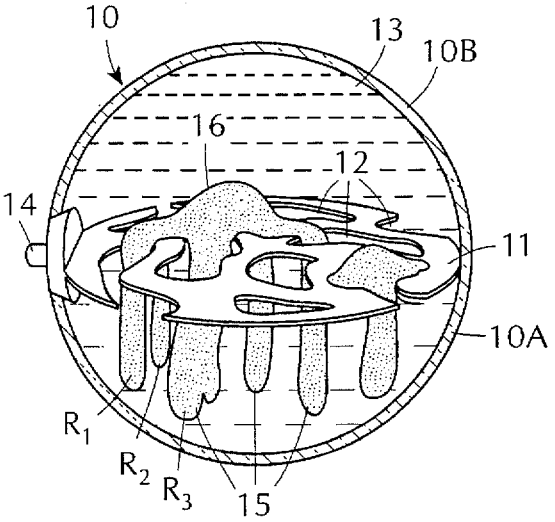
FIG. 3 is a section taken through the ball showing how simulated lava is produced.

But when a player who grasps the ball turns it upside down, as shown in FIG. 3, then half-section 10B, is now the upper section of the ball, and pool 15 of syrup that lies in this upper section above partition 12.

As a consequence of gravity flow, the syrup in pool 13 impinges on partition 12 and is broken up to pass through the separate openings A, B, C, D., etc., in the partition.

The syrup emerges from these openings as rivulets $R_a$, $R_b$, $R_c$, etc., whose cross sectional shapes conform to those of the shaped openings, these distinctively colored rivulets pass through the transparent mineral oil medium in the lower half-section to collect at the bottom of this section to reform the syrup pool.

Hence the holder of the upside down playball sees rivulets which simulate the appearance of lava emerging from volcanic vents, and these rivulets of lava therefore appear to emerge from the hands of the player.

While there has been shown and described a preferred embodiment of a lava-producing playball, it will be appreciated that many changes and modifications may be made therein without, however, departing from the essential spirit thereof.

I claim:

1. A playball which when manipulated by a player produces a display simulating the flow of lava, said playball comprising:

A. a sphere formed of transparent plastic material having a partition therein dividing the sphere into upper and lower half-sections, and partition having openings dispersed therein; and B. a clear oil filling the sphere having a charge of a water-based syrup having a distinctive color deposited therein which is immiscible with the oil and normally forms a pool at the bottom of the lower section of the sphere, whereby when a player turns the sphere upside down, the pool is then in the upper section of the sphere and by gravity flow the pool impinges on the partition and is separated thereby at the partition to pass through the openings to form rivulets which simulate lava and collect at the bottom of the sphere to reform the pool.

2. A playball as set forth in claim 1, in which the sphere is made of two half sections which are joined together to define an equator.

3. A playball as set forth in claim 2, in which the partition is formed of a clear plastic plate which is supported at the equator.

4. A playball as set forth in claim 2, in which the openings in the partition have different shapes.

5. A playball as set forth in claim 1, in which the sphere is provided with a plug valve through which the oil and syrup are injected into the sphere.

6. A playball as set forth in claim 1, in which the sphere is formed of transparent polyethylene.

7. A playball as set forth in claim 1, in which the partition is formed of a transparent plastic plate.

8. A playball as set forth in claim 1, in which the oil is a light mineral oil.

9. A playball as set forth in claim 1, in which the syrup is a corn syrup.

* * * * *